US012193510B2

(12) United States Patent
Lei et al.

(10) Patent No.: US 12,193,510 B2
(45) Date of Patent: Jan. 14, 2025

(54) ATOMIZER AND ELECTRONIC ATOMIZING DEVICE

(71) Applicant: Shenzhen Smoore Technology Limited, Shenzhen (CN)

(72) Inventors: Guilin Lei, Shenzhen (CN); Zhihua Wen, Shenzhen (CN); Ru Jiang, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 356 days.

(21) Appl. No.: 17/730,211

(22) Filed: Apr. 27, 2022

(65) Prior Publication Data

US 2022/0248765 A1 Aug. 11, 2022

Related U.S. Application Data

(63) Continuation of application No. PCT/CN2020/093475, filed on May 29, 2020.

(51) Int. Cl.
*A24F 13/00* (2006.01)
*A24F 40/10* (2020.01)
(Continued)

(52) U.S. Cl.
CPC ..... *A24F 40/485* (2020.01); *A24F 40/10* (2020.01); *A24F 40/42* (2020.01)

(58) Field of Classification Search
CPC ..... A24F 47/00
(Continued)

(56) References Cited

U.S. PATENT DOCUMENTS 11,533,950 B1 * 12/2022 Wu ..... A24F 40/42
2010/0031968 A1 2/2010 Sheikh et al.
(Continued)

FOREIGN PATENT DOCUMENTS

CN 204120221 U 1/2015
CN 204409583 U 6/2015
(Continued)

OTHER PUBLICATIONS

European Search Report, European Application No. 20938240.7, mailed Jul. 4, 2023 (41 pages).
(Continued)

*Primary Examiner* — Phuong K Dinh

(57) ABSTRACT

An atomizer includes: a housing, defining a first airflow passage through an inlet end and an outlet end; a liquid storage chamber, disposed within the housing; an atomizing assembly, disposed in a path of the first airflow passage, the atomizing assembly is in fluid connection with the liquid storage chamber; a sealing element, including a sealing body and an air compensating valve, the sealing body is configured to form a seal between the housing and the atomizing assembly, the air compensating valve includes a first side and a second side opposite to each other, the first side is located within the liquid storage chamber, the second side communicates with external air. The air compensating valve is opened when a pressure of the external air on the second side is greater than a pressure in the liquid storage chamber on the first side.

20 Claims, 13 Drawing Sheets

(51) Int. Cl.
*A24F 40/42* (2020.01)
*A24F 40/485* (2020.01)

(58) Field of Classification Search
USPC ..... 131/328–329
See application file for complete search history.

(56) References Cited

U.S. PATENT DOCUMENTS

| | | | | |
|---|---|---|---|---|
| 2018/0154092 | A1 | 6/2018 | Patoret | |
| 2020/0085108 | A1 | 3/2020 | Li et al. | |
| 2020/0376210 | A1 | 12/2020 | Simpson et al. | |
| 2023/0210188 | A1* | 7/2023 | Courbat | A24F 40/42 131/329 |

FOREIGN PATENT DOCUMENTS

| | | | |
|---|---|---|---|
| CN | 206043437 | U | 3/2017 |
| CN | 107690289 | A | 2/2018 |
| CN | 107692319 | A | 2/2018 |
| CN | 108095197 | A | 6/2018 |
| CN | 109007980 | A | 12/2018 |
| CN | 208434720 | U | 1/2019 |
| CN | 109452691 | A | 3/2019 |
| CN | 110250577 | A | 9/2019 |
| CN | 110338461 | A | 10/2019 |
| CN | 110403246 | A | 11/2019 |
| CN | 110477455 | A | 11/2019 |
| CN | 110613172 | A | 12/2019 |
| CN | 209711531 | U | 12/2019 |
| CN | 209711540 | U | 12/2019 |
| CN | 209807135 | U | 12/2019 |
| CN | 209950393 | U | 1/2020 |
| CN | 209965243 | U | 1/2020 |
| CN | 210017879 | U | 2/2020 |
| CN | 210017903 | U | 2/2020 |
| CN | 210054615 | U | 2/2020 |
| CN | 110893016 | A | 3/2020 |
| CN | 210130350 | U | 3/2020 |
| CN | 210130351 | U | 3/2020 |
| CN | 210130352 | U | 3/2020 |
| CN | 210130353 | U | 3/2020 |
| CN | 210130354 | U | 3/2020 |
| CN | 210130355 | U | 3/2020 |
| CN | 210184514 | U | 3/2020 |
| CN | 210226908 | U | 4/2020 |
| CN | 210275886 | U | 4/2020 |
| CN | 111134376 | A | 5/2020 |
| CN | 111165888 | A | 5/2020 |
| CN | 111631437 | A | 9/2020 |
| CN | 111642801 | A | 9/2020 |
| CN | 211482971 | U | 9/2020 |
| CN | 211746967 | U | 10/2020 |
| CN | 212306800 | U | 1/2021 |
| CN | 212345299 | U | 1/2021 |
| CN | 112617295 | A | 4/2021 |
| CN | 212911660 | U | 4/2021 |
| CN | 213604379 | U | 7/2021 |
| CN | 214710337 | U | 11/2021 |
| CN | 214759109 | U | 11/2021 |
| WO | 2015037925 | A1 | 3/2015 |
| WO | WO2017163052 | A1 | 9/2017 |
| WO | 2019019331 | A1 | 1/2019 |
| WO | WO2020173432 | A1 | 9/2020 |

OTHER PUBLICATIONS

International search report, International Application No. PCT/CN2020/093475, mailed Feb. 26, 2021 (17 pages).
Chinese First Office Action, Chinese Application No. 202010479403.4, mailed Sep. 25, 2024 (22 pages).
European Notice of Allowance, European Application No. 20938240.7, mailed Aug. 2, 2024 (36 pages).).

* cited by examiner

ATOMIZER AND ELECTRONIC ATOMIZING DEVICE

CROSS REFERENCE

The present application is a continuation-application of International (PCT) Patent Application No. PCT/CN2020/093475, filed on May 29, 2020, which is entirely incorporated into the present application by reference.

TECHNICAL FIELD

The present disclosure relates to the field of electronic atomizing technology, and more particularly to an atomizer and an electronic atomizing device.

BACKGROUND

Electronic atomizing device, such as electronic cigarette etc, are generally provided with an atomizer, and the atomizer can atomize aerosol generating material stored thereof for users to inhale. Traditional atomizer usually conducts tobacco oil to an atomizing element through capillary forces for atomization by heating. However, when the atomize aerosol generating material is atomized at a rapid speed, an air pressure in a tobacco oil chamber is reduced, an unsmooth liquid supply is easy to occur. At this time, the aerosol generating material cannot be replenished to an atomizing element timely, which leads the atomizing element to be overheated. As a result, the atomizing element is damaged, and burning smell and hazardous substance is generated.

Accordingly, it is desirable to provide an atomizer and an electronic atomizing device to overcome the aforementioned problems.

SUMMARY

The present disclosure discloses an atomizer and an electronic atomizing device. The atomizer includes: a housing, defining a first airflow passage through an inlet end and an outlet end; a liquid storage chamber, disposed within the housing; an atomizing assembly, disposed in a path of the first airflow passage, the atomizing assembly is in fluid connection with the liquid storage chamber; a sealing element, including a sealing body and an air compensating valve, the sealing body is configured to form a seal between the housing and the atomizing assembly, the air compensating valve includes a first side and a second side opposite to each other, the first side is located within the liquid storage chamber, the second side communicates with external air. The air compensating valve is opened when a pressure of the external air on the second side is greater than a pressure in the liquid storage chamber on the first side.

BRIEF DESCRIPTION OF THE DRAWINGS

In order to illustrate the technical solutions in the embodiments of the present disclosure or the prior art more clearly, the following will briefly introduce the figures needed to be used in the description of the embodiments or the prior art. Obviously, the drawings in the following description are only some embodiments of the present disclosure; those skilled in the art may derive other figures from these figures without paying any creative work.

DETAILED DESCRIPTION

The technical solutions in the embodiments of the present disclosure will be described clearly and completely with reference to the figures in the embodiments of the present disclosure. Obviously, the described embodiments are only a part of the embodiments of the present disclosure, rather than all the embodiments. Based on the embodiments of the present disclosure, all other embodiments obtained by those skilled in the art without any creative work are within the scope of the present disclosure.

Figure 1:
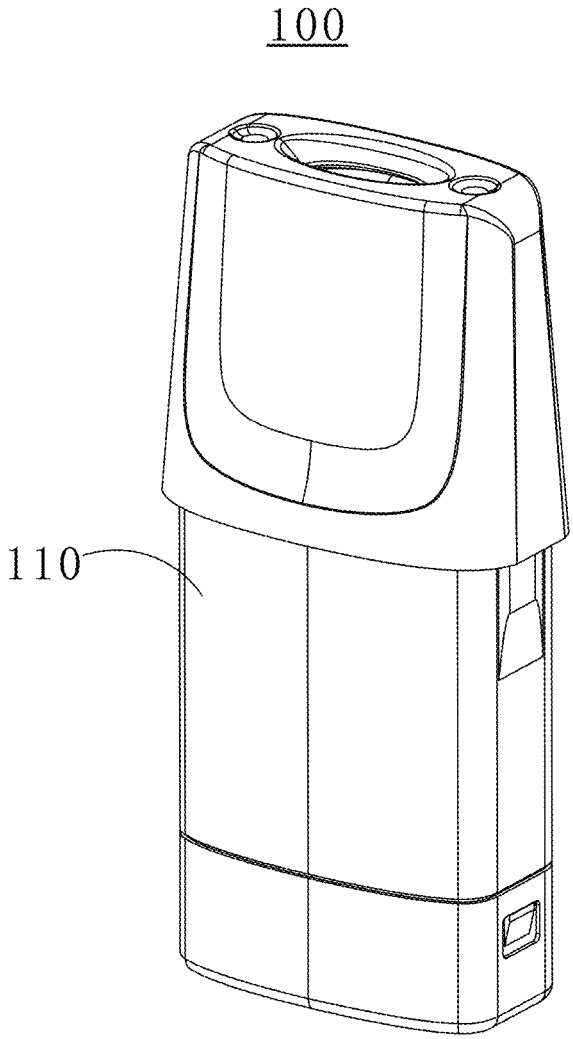
FIG. 1 is a perspective structural schematic view of an embodiment of an atomizer of the present disclosure.
Figure 2:
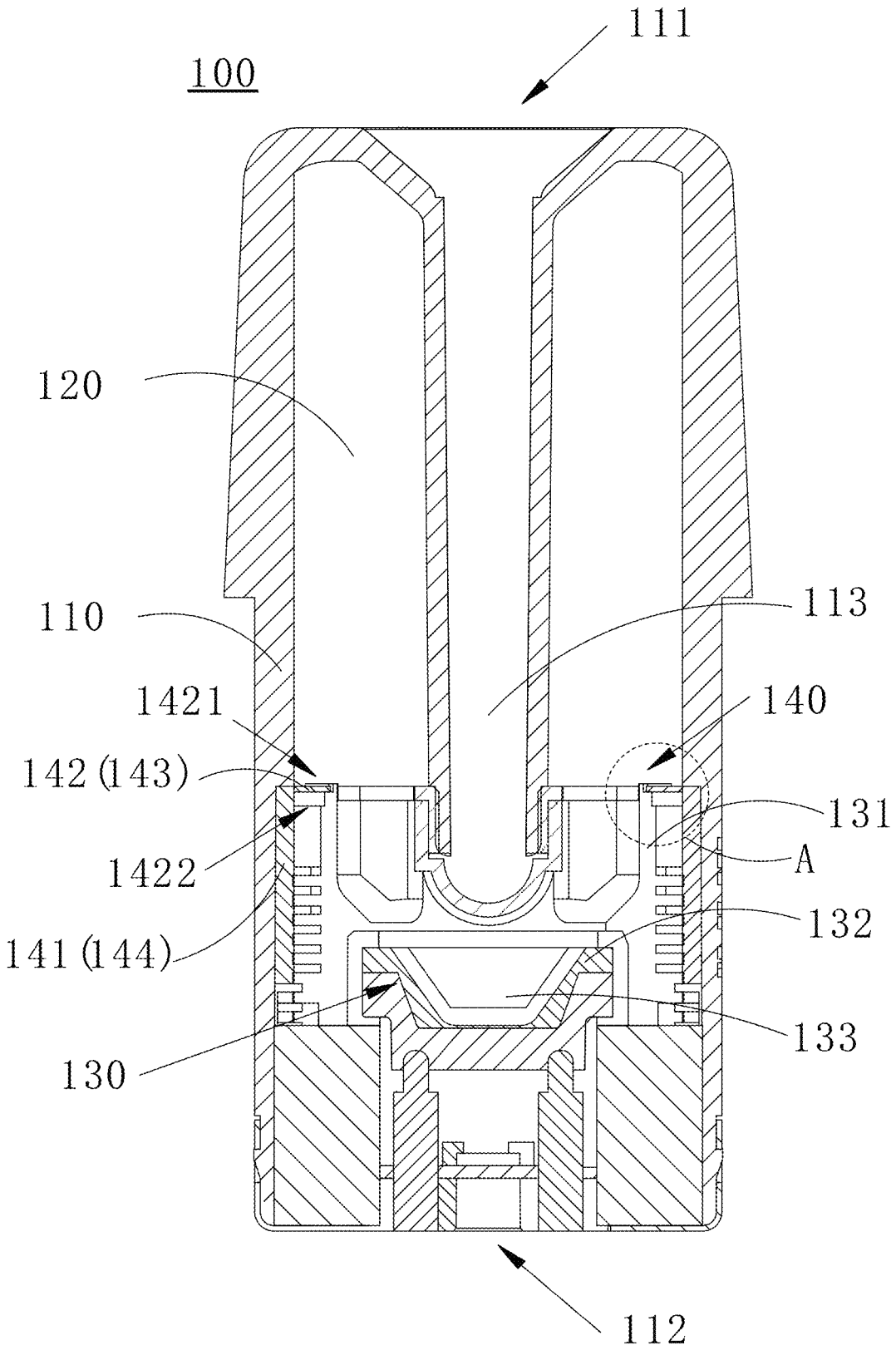
FIG. 2 is a cross-sectional structural schematic view of an embodiment of an atomizer of the present disclosure.
Figure 3:
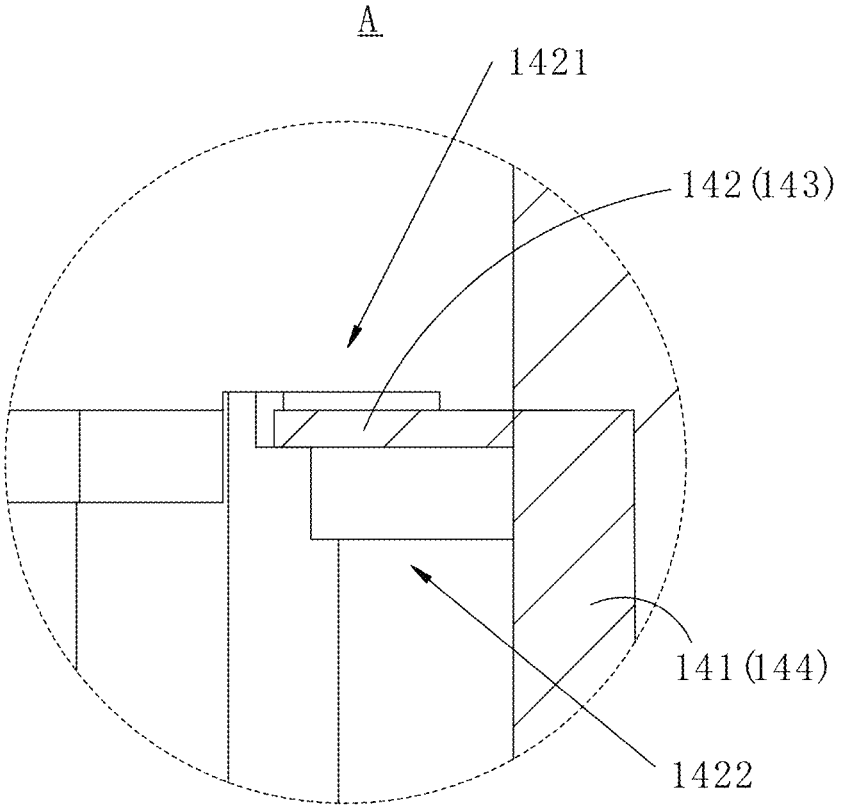
FIG. 3 is an enlarged schematic view of portion A of FIG. 2.
Figure 4:
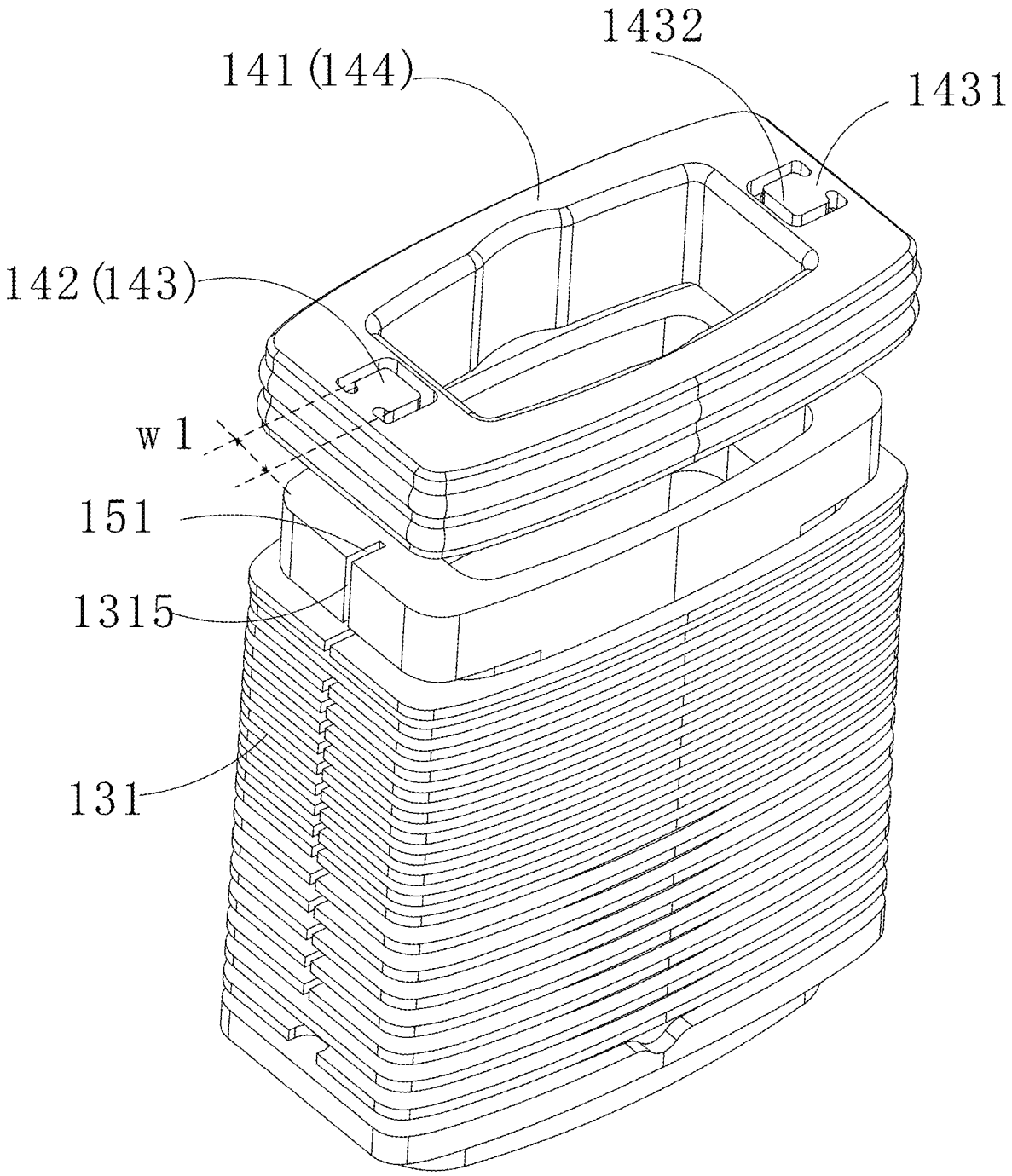
FIG. 4 is an exploded structural schematic view of an atomizing assembly and a seal element of an embodiment of an atomizer of the present disclosure.

FIG. 1 is a perspective structural schematic view of an embodiment of an atomizer of the present disclosure. FIG. 2 is a cross-sectional structural schematic view of an embodiment of an atomizer of the present disclosure. FIG. 3 is an enlarged schematic view of portion A of FIG. 2. FIG. 4 is an exploded structural schematic view of part of an embodiment of an atomizer of the present disclosure.

As shown in FIGS. 1 and 2, embodiments of the present disclosure provide an atomizer 100. The atomizer 100 includes a housing 110, a liquid storage chamber 120, an atomizing assembly 130, and a sealing element 140. Wherein, the housing 110 includes an inlet end 112 used for air inflow and an outlet end 111 used for air outflow. The housing 110 defines a first airflow passage 113 through the inlet end 112 and the outlet end 111. The liquid storage chamber 120 is disposed within the housing 110, and configured to store aerosol generating material. The atomizing assembly 130 is disposed in the path of the first airflow passage 113. The atomizing assembly 130 is in fluid connection with the liquid storage chamber 120. The atomizing assembly 130 is configured to atomize the aerosol generating material. The sealing element 140 includes a sealing body 141 and an air compensating valve 142. The sealing element 140 is configured to form a seal between the housing 110 and the atomizing assembly 130, to improve air impermeability of an assembly of the atomizing assembly 130 and the housing 110. The air compensating valve 142 is a one-way valve. The air compensating valve 142 includes a first side 1421 and a second side 1422 opposite to each other. The first side 1421 communicates with the liquid storage chamber 120. The second side 1422 communicates with external air directly or indirectly.

During operation of the atomizer 100 described above, when a pressure of the external air on the second side 1422 is greater than a pressure in the liquid storage chamber 120 on the first side 1421, and a differential-pressure reaches a threshold which can push the air compensating valve 142 to rotate, the air compensating valve 142 is opened, the external air enters the liquid storage chamber 120 through the air compensating valve 142, to supply an air pressure in the liquid storage chamber 120, thus a situation that the air pressure in the liquid storage chamber 120 is too low can be avoided, a situation that the liquid cannot penetrate to the atomizing assembly 130 for atomization can be avoided, a fluency of atomizing liquid supply is improved, and a situation that the atomizing assembly 130 is overheated due to an unsmooth liquid supply is avoided. It should be noted that the air compensating valve 142 is a one-way valve. In a normal situation, the pressure in the liquid storage chamber 120 is greater than or equal to the pressure of the external air, the liquid storage chamber 120 supplies liquid smoothly, and the air compensating valve 142 is in a closed state, thus, the aerosol generating material inside the liquid storage chamber 120 is prevented from leaking through the air compensating valve 142.

Wherein the sealing body 141 is a sealing silicone element 144, the air compensating valve 142 is an elastic element 143. The air compensating valve 142 and the sealing body 141 are integrally formed, so that an assembly of the sealing body 141 and the atomizing assembly 130 is more convenient.

Specifically, when the pressure of the external air on the second side 1422 of the air compensating valve 142 is 200-2000 pa greater than the pressure in the liquid storage chamber 120 on the first side 1421 of the air compensating valve 142, the air compensating valve 142 is opened, such as 200 pa, 600 pa, 1000 pa, 1500 pa or 2000 pa etc. In an embodiment, when the pressure of the external air on the second side 1422 of the air compensating valve 142 is 600-1500 pa greater than the pressure in the liquid storage chamber 120 on the first side 1421 of the air compensating valve 142, the air compensating valve 142 is opened, such as 600 pa, 900 pa, 1000 pa or 1500 pa etc.

In an embodiment, as shown in FIGS. 2-4, the atomizing assembly 130 includes an atomizing base 131. An outer surface of the atomizing base 131 defines a groove 1315. The groove 1315 communicates with the external air and extends into the liquid storage chamber 120, so that the external air to enter the liquid storage chamber 120. The sealing body 141 is the sealing silicone element 144. The sealing silicone element 144 sheathes on the outer surface of the atomizing base 131. The sealing silicone element 144 defines an air exchange passage 150 together with the groove 1315, so that the external air enters the liquid storage chamber 120. An end of the air exchange passage 150 near the liquid storage 120 chamber severs as an air outlet 151. The elastic element 143 is located at a side of the atomizing base 131 near the liquid storage chamber 120, and covers the air outlet 151. The elastic element 143 includes a first end 1431 connected to the sealing silicone element 144 and a second end 1432 opposite to the first end 1431. When a pressure of one side of the elastic element 143 away from the liquid storage chamber 120 is greater than a pressure of the other side of the elastic element 143 facing the liquid storage chamber 120, and a differential-pressure reaches a threshold which can push the elastic element 143 to rotate, the second end 1432 of the elastic element 143 rotates toward the liquid storage chamber 120, so that the external air can enter the liquid storage chamber 120 from the air outlet 151.

In an embodiment, as shown in FIG. 2, the atomizing assembly 130 further includes an atomizing element 132 and an atomizing chamber 133. The atomizing element 132 is disposed in the atomizing base 131. The atomizing chamber 133 is disposed within the atomizing element 132. The atomizing element 132 atomizes the aerosol generating material which is stored within the liquid storage chamber 120 in the atomizing chamber 133.

The elastic element 143 may be set in a variety of ways. The elastic element 143 may be disposed perpendicular to a central axis of the atomizer 100, or the elastic element 143 is disposed parallel to the central axis of the atomizer 100. In an embodiment, as shown in FIG. 4, the air outlet 151 is disposed on a top of the atomizing base 131, that is, a side of the atomizing base 131 near the liquid storage chamber 120. The air outlet 151 is located at a plane perpendicular to the central axis of the atomizer 100. The air outlet 151 may be a slit. In a natural state, the elastic element 143 horizontally abuts against the top of the atomizing base 131 corresponding to the air outlet 151; a width wl of the elastic element 143 is greater than a width of the air outlet 151 to completely cover the air outlet 151, the elastic element 143 abuts against the top of the atomizing base 131. When a pressure of the external air within the air exchange passage 150 is greater than a pressure in the liquid storage chamber 120, and the differential-pressure reaches a threshold which can push the elastic element 143 to rotate, the elastic element 143 rotates upward, and the external air within the air exchange passage 150 passes through the air outlet 151 and enters the liquid storage chamber 120, to supply the air pressure in the liquid storage chamber 120. When the pressure in the liquid storage chamber 120 is greater than or equal to the pressure of the external air within the air exchange passage 150, the elastic element 143 abuts against the top of the atomizing base 131 corresponding to the air outlet 151 under an effect of air pressure from top to bottom, to prevent a leakage of the aerosol generating material within the liquid storage chamber 120.

In order to control a range of elastic force of the elastic element 143, to make it easier to rotate upward when the pressure of the external air within the air exchange passage 150 is greater than the pressure in the liquid storage chamber 120, as shown in FIG. 3, a thickness of the first end 1431 of the elastic element 143 is less than a thickness of the second end 1432 of the elastic element 143, and a width of the first end 1431 of the elastic element 143 is less than a width of the second end 1432 of the elastic element 143, so that the elastic element 143 is more sensitive to a pressure change on both sides, and easier to rotate toward the side of the liquid storage chamber 120 when the pressure in the liquid storage chamber 120 is too low, to replenish the external air to the liquid storage chamber 120. In particular, the range of elastic force of the elastic element 143 can be considered comprehensively according to a density of the aerosol generating material within the liquid storage chamber 120, a liquid absorption capacity of the atomizing assembly 130, and etc, and then adjust the thickness and the width of the first end 1431 of the elastic element 143, to make its range of elastic force suitable.

Figure 5:
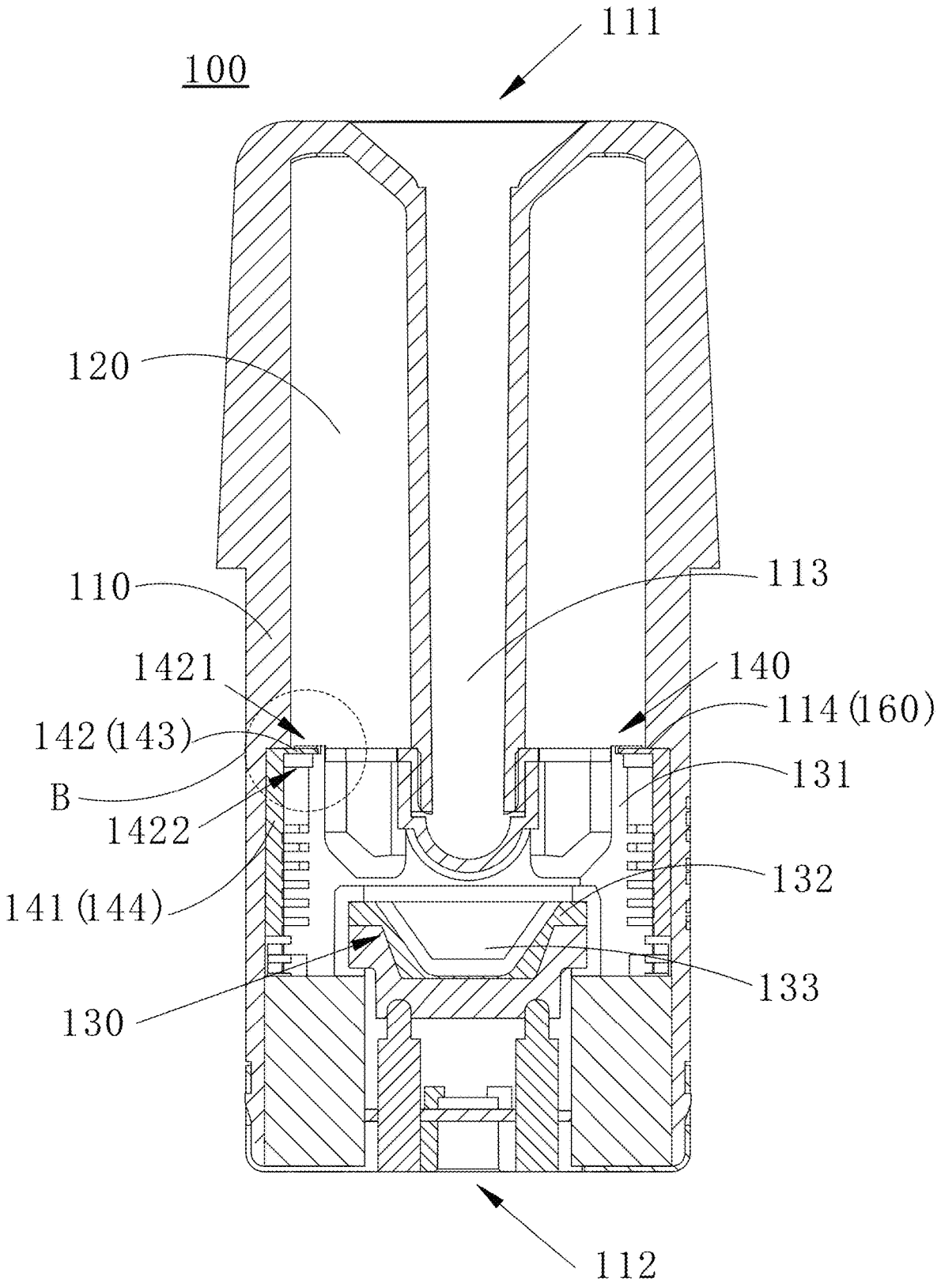
FIG. 5 is a cross-sectional structural schematic view of an embodiment of an atomizer of the present disclosure.
Figure 6:
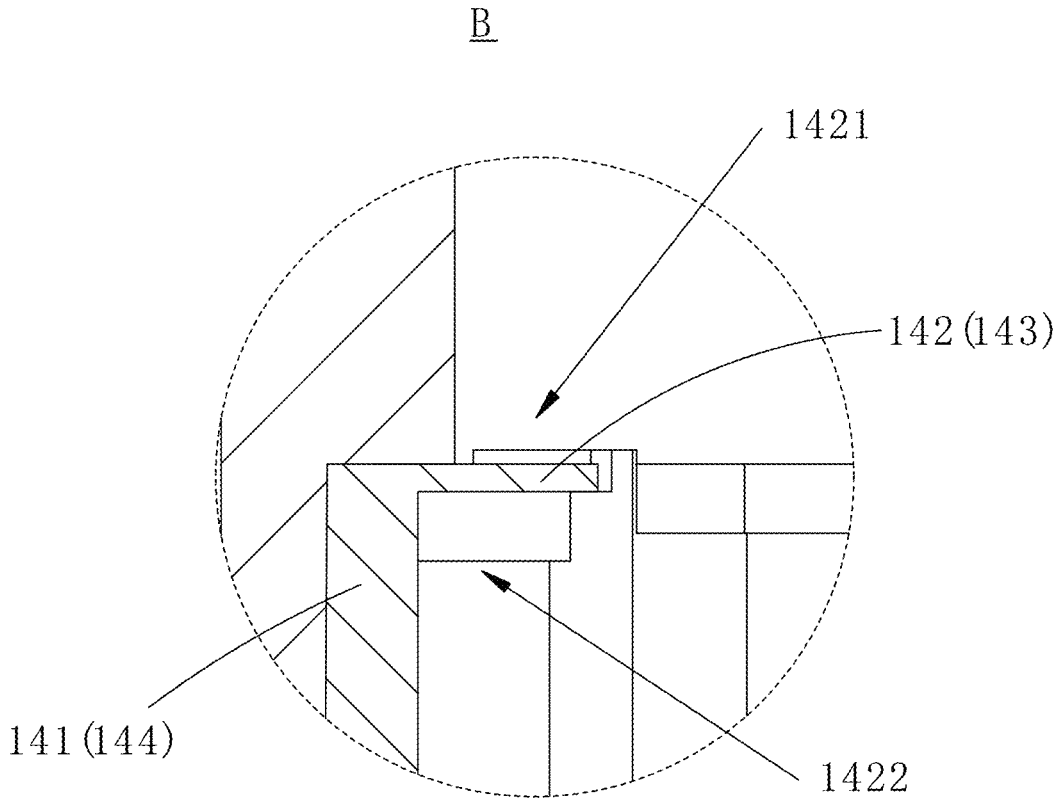
FIG. 6 is an enlarged schematic view of portion B of FIG. 5.
Figure 7:
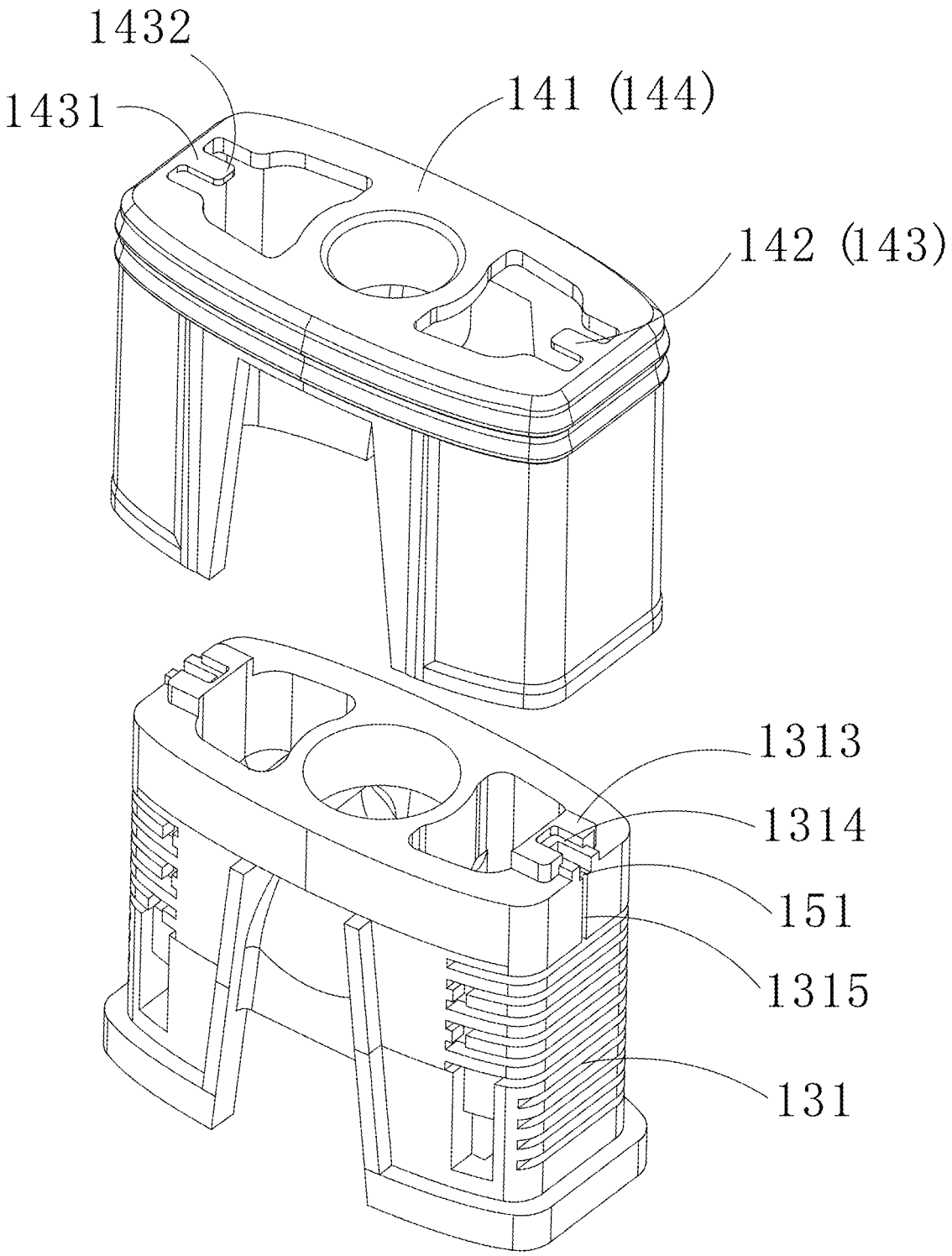
FIG. 7 is an exploded structural schematic view of an atomizing assembly and a seal element of an embodiment of an atomizer of the present disclosure.

FIG. 5 is a cross-sectional structural schematic view of another embodiment of an atomizer of the present disclosure. FIG. 6 is an enlarged schematic view of portion B of FIG. 5. FIG. 7 is an exploded structural schematic view of part of another embodiment of an atomizer of the present disclosure.

In this embodiment, a structure of the atomizer 100 and a path of the external air into the liquid storage chamber 120 are approximately the same as the embodiment shown in FIGS. 1-3. As shown in FIGS. 5-7, the air outlet 151 is located on the top of the atomizing base 131, in a natural state, the elastic element 143 horizontally abuts against the top of the atomizing base 131 corresponding to the air outlet 151. The difference is that, the elastic element 143 is a rubber elastic element; the atomizer 100 further includes a blocking element 160 to limit opening amplitude of the elastic element 143. Specifically, the blocking element 160 includes a first step surface 114 disposed on an inner surface of the housing 110, the first step surface 114 abuts against an upper surface of the first end 1431 of the elastic element 143, the first end 1431 of the elastic element 143 is located between the atomizing base 131 and the first step surface 114. Since the elastic element 143 is an elastic material, such as a silicone material, the elastic element 143 is prone to warp. The first end 1431 of the elastic element 143 of the present disclosure is located between the atomizing base 131 and the first step surface 114; the first step surface 114 may apply pressure to the first end 1431 of the elastic element 143. The first step surface 114 does not affect a rotation of the elastic element 143 in the liquid storage chamber 120, meanwhile, the first step surface 114 may limit opening range of the elastic element 143, so that an excessive rotation of the elastic element 143 in a vertical direction is avoided, and the elastic element 143 is prevented from deforming or warping. Further, the first step surface 114 may improve an installation convenience of the sealing silicone element 144, and facilitate rapid positioning and installation of the sealing silicone element 144.

In addition, after installation, the elastic element 143 is prone to migrate in a horizontal direction. As a result, the elastic element 143 cannot completely cover the air outlet 151, which may cause a failure of sealing function of the elastic element 143. Thus, as shown in FIG. 5, a supporting part 1313 is disposed on the top of the atomizing base 131. A center of the supporting part 1313 recesses to form a receiving chamber 1314 to receive the elastic element 143. The receiving chamber 1314 limits the elastic element 143, prevents the elastic element 143 from migrating in a horizontal direction, and maintains the sealing function of the elastic element 143.

Further, a width of the receiving chamber 1314 is greater than a width of the elastic element 143. That is, there is an interval between the supporting part 1313 and the elastic element 143, which may avoid a friction between the supporting part 1313 and the elastic element 143, so as to ensure that the elastic element 143 rotates smoothly to the liquid storage chamber 120 when the pressure of the external air within the air exchange passage 150 is greater than the pressure in the liquid storage chamber 120.

Figure 8:
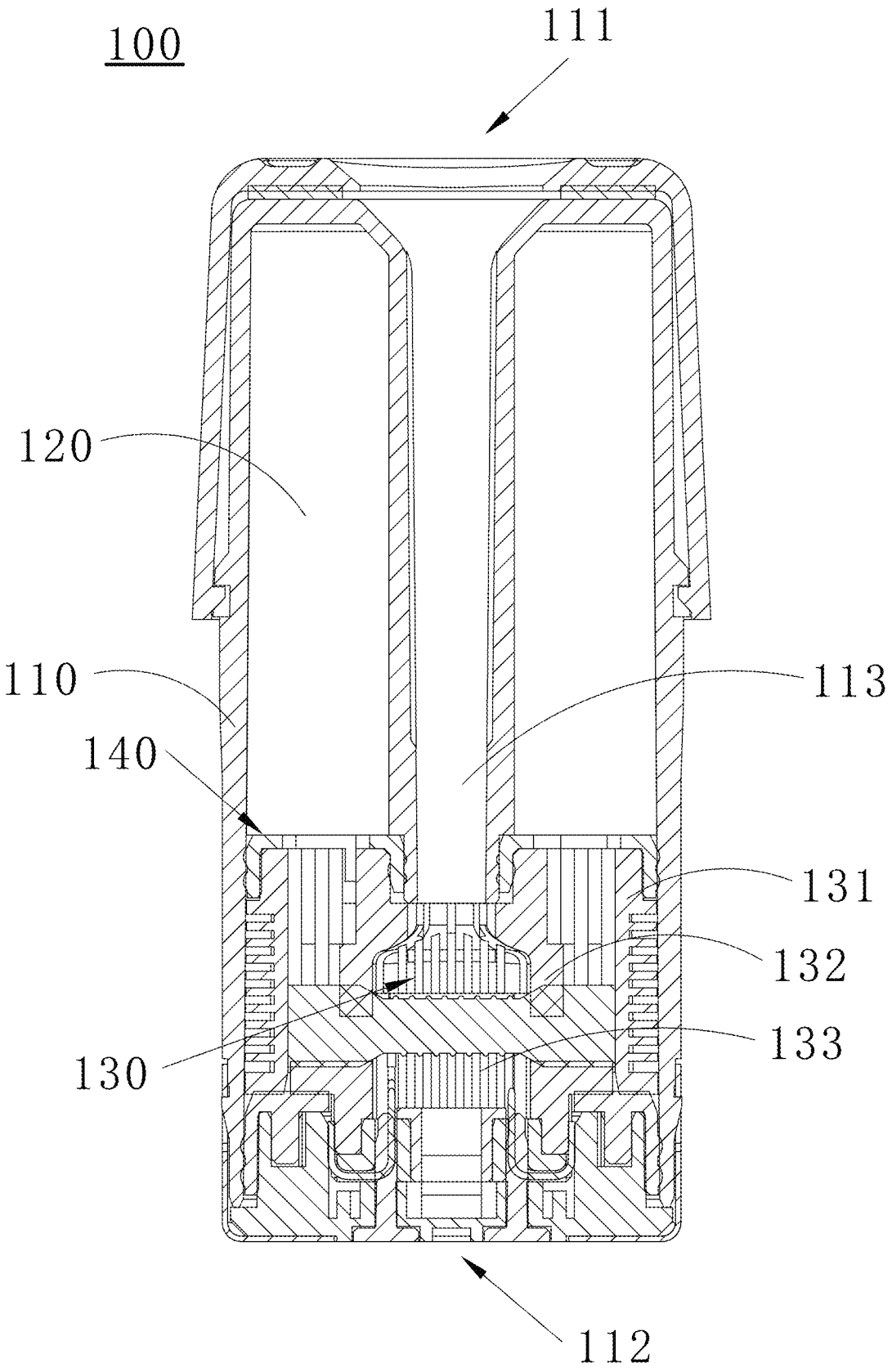
FIG. 8 is a cross-sectional structural schematic view of an embodiment of an atomizer of the present disclosure.
Figure 9:
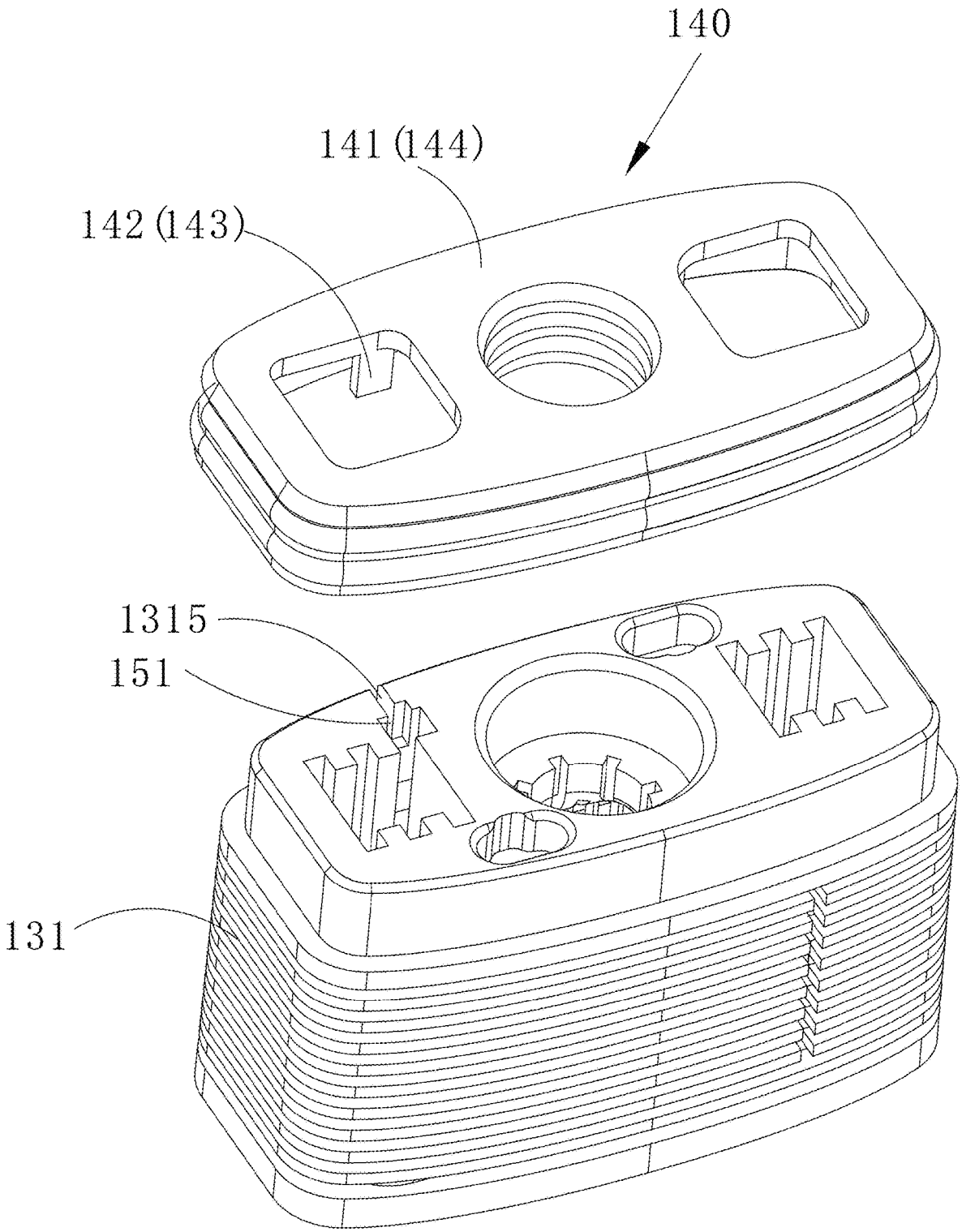
FIG. 9 is an exploded structural schematic view of an atomizing assembly and a seal element of an embodiment of an atomizer of the present disclosure.
Figure 10:
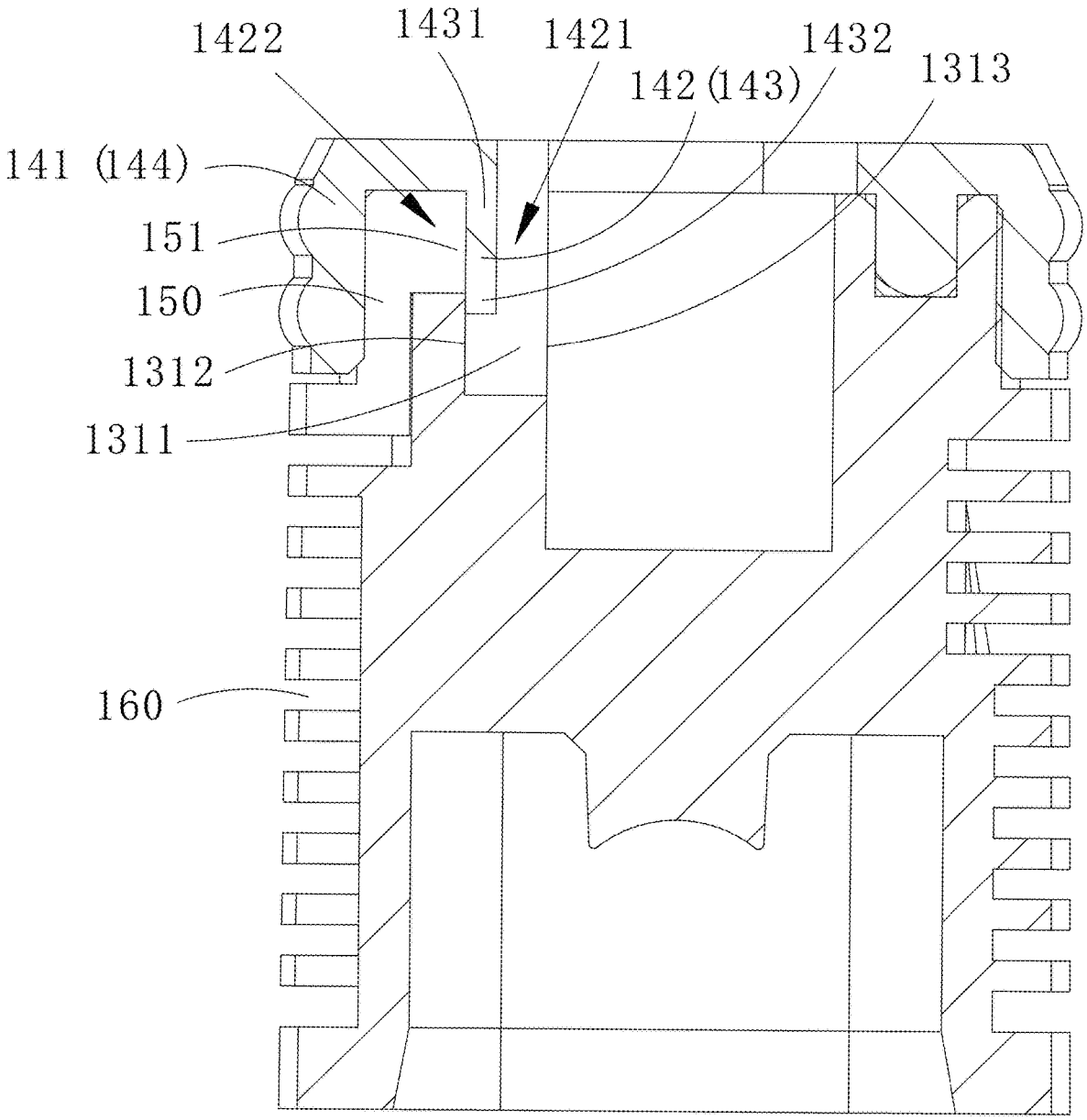
FIG. 10 is a cross-sectional structural schematic view of an atomizing assembly and a seal element of an embodiment of an atomizer of the present disclosure.
Figure 11:
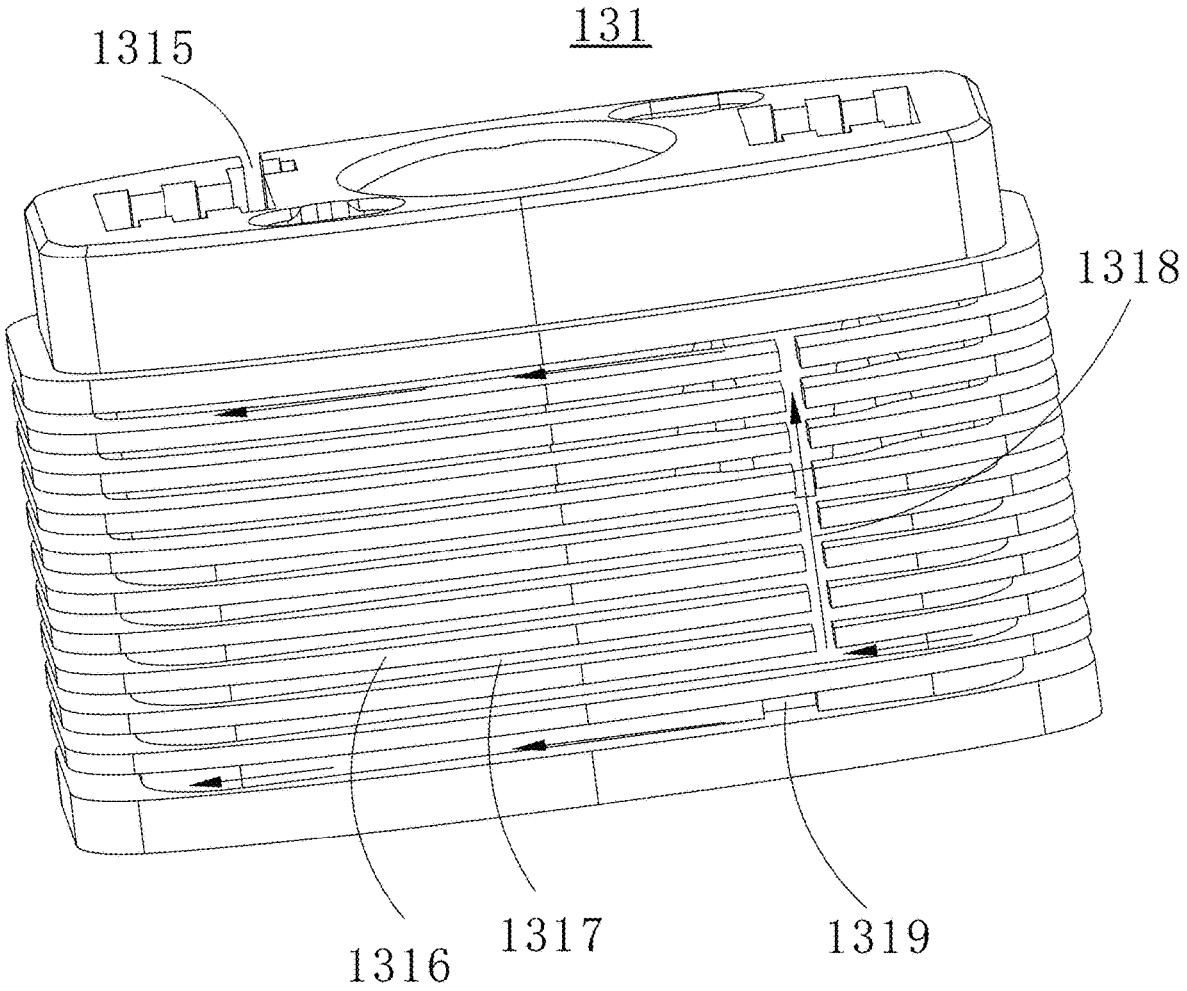
FIG. 11 is a perspective structural schematic view of an atomizing base of an embodiment of an atomizer of the present disclosure.
Figure 12:
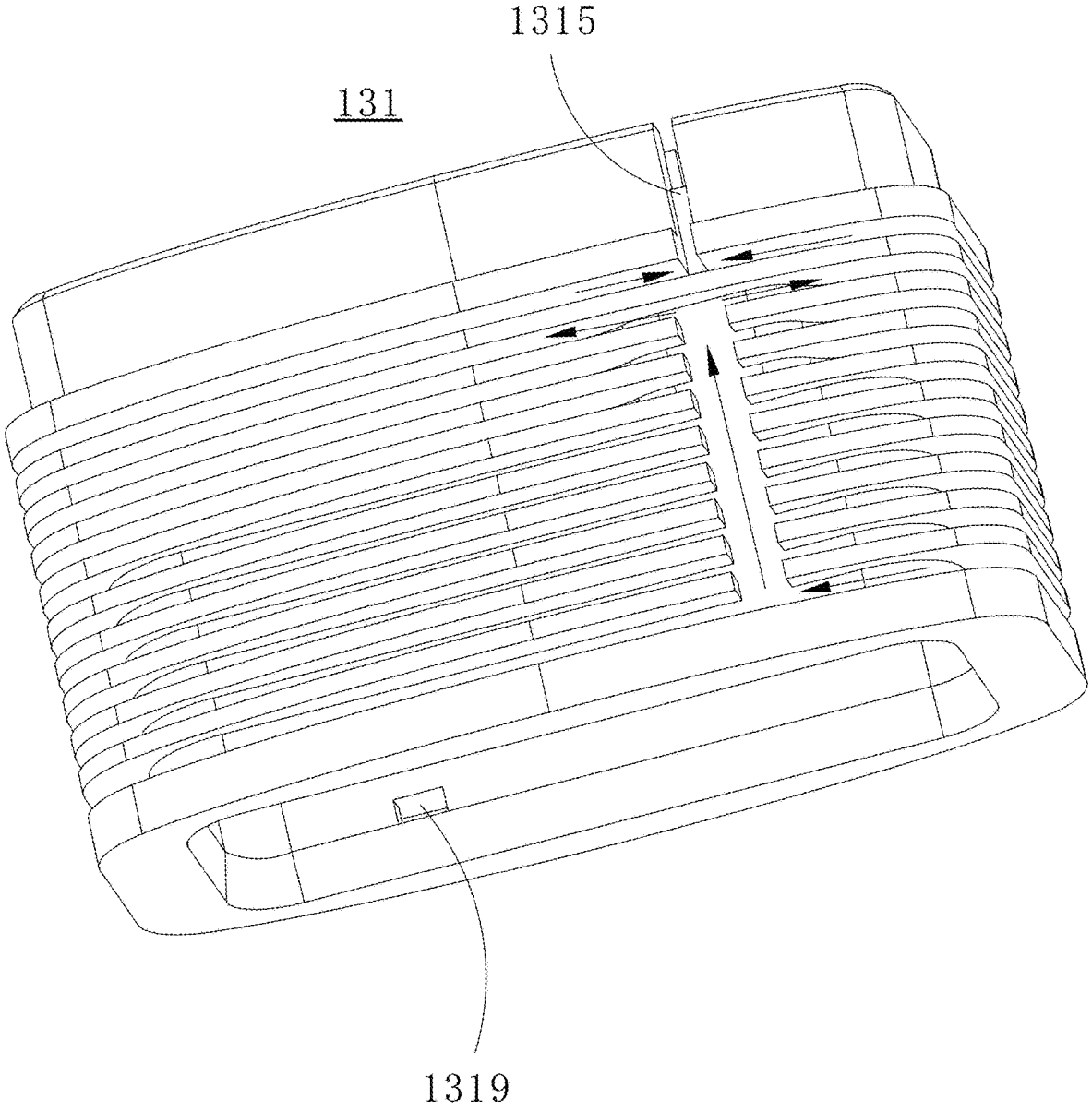
FIG. 12 is another perspective structural schematic view of an atomizing base of an embodiment of an atomizer of the present disclosure.

Please refer to FIGS. 8-12, FIG. 8 is a cross-sectional structural schematic view of another embodiment of an atomizer of the present disclosure; FIG. 9 is an exploded structural schematic view of part of another embodiment of an atomizer of the present disclosure; FIG. 10 is a cross-sectional structural schematic view of part of another embodiment of an atomizer of the present disclosure; FIG. 11 is a perspective structural schematic view of an atomizing base of an embodiment of an atomizer of the present disclosure; FIG. 12 is another perspective structural schematic view of an atomizing base of an embodiment of an atomizer of the present disclosure.

In this embodiment, the structure of the atomizer 100 and the path of the external air into the liquid storage chamber 120 are approximately the same as the embodiment shown in FIGS. 1-5. The difference is that, the elastic element 143 is disposed parallel to the central axis of the atomizer 100. Specifically, as shown in FIGS. 8-11, the air outlet 151 is disposed within the atomizing base 131 vertically. In a natural state, the elastic element 143 vertically abuts against an inner surface of the atomizing base corresponding to the air outlet 151.

Specifically, as shown in FIGS. 8 and 11, the atomizing base 131 defines a vertical groove 1311 along a direction parallel to the central axis of the atomizer 100 inside the atomizing base 131. A top of the vertical groove 1311 communicates with the liquid storage chamber 120. The vertical groove 1311 includes a first side wall 1312 and a second side wall 1313 opposite to the first side wall 1312, and the air outlet 151 of the air exchange passage 150 is located at the first side wall 1312. When the pressure of the external air within the air exchange passage 150 is greater than the pressure in the liquid storage chamber 120, and the differential-pressure reaches a threshold which can push the elastic element 143 to rotate, the elastic element 143 rotates in the vertical groove 1311, the external air within the air exchange passage 150 enter the vertical groove 1311 through the air outlet 151, and then enter the liquid storage chamber 120, to supply the air pressure in the liquid storage chamber 120. When the pressure in the liquid storage chamber 120 is greater than or equal to the pressure of the external air within the air exchange passage 150, the elastic element 143 closely abut against the vertical groove 1311 corresponding to the air outlet 151 under an effect of a high pressure in the liquid storage chamber 120, to prevent the leakage of the aerosol generating material within the liquid storage chamber 120.

Since the elastic element 143 is disposed within the vertical groove 1311, the vertical groove 1311 may limit the elastic element 143, and avoids a migration of elastic element 143 which result in the condition that the elastic element 143 cannot completely cover the air outlet 151, so as to maintain the sealing function of the elastic element 143. Further, the blocking element 160 in this embodiment is the second side wall 1313. The elastic element 143 abuts against the first side wall 1312, a distance between the first side wall 1312 and the second side wall 1313 is greater than a thickness of the elastic element 143, and less than a length of the elastic element 143. The thickness of the elastic element 143 refers to a thickness in a direction from the first side wall 1312 to the second side wall 1313. The length of the elastic element 143 refers to a length in a direction from the first end 1431 to the second end 1432. Rotation amplitude of the elastic element 143 toward the second side wall 1313 is related to the differential-pressure between the external air within the air exchange passage 150 and the liquid storage chamber 120. The greater the differential-pressure, the greater is the rotation amplitude of the elastic element 143. The second side wall 1313 may limit the opening amplitude of the elastic element 143, to avoid an excessive rotation of the elastic element 143 in a vertical direction, so as to prevent the elastic element 143 from deforming or warping.

It should be noted that, the distance between the first side wall 1312 and the second side wall 1313 may be adjusted according to an elastic capability of the elastic element 143, and the length of the first end 1431 to the second end 1432 of the elastic element 143, so that the elastic element 143 can rotate toward the second side wall 1313 for the external air to enter the vertical groove 1311 through the air outlet 151. At the same time, the excessive rotation of the elastic element 143 in a vertical direction is avoided, so as to prevent the elastic element 143 from deforming or warping.

In an embodiment, the air exchange passage 150 communicates with the atomizing chamber 133. Specifically, as shown in FIGS. 11 and 12, the outer surface of the atomizing base 131 is provided with a plurality of fins 1316. The plurality of fins 1316 are arranged with parallel intervals. Adjacent fins 1316 define horizontal capillary grooves 1317. The atomizing base 131 further includes at least one vertical vent groove 1318. The at least one vertical vent groove 1318 communicates with the horizontal capillary grooves 1317. The atomizing base 131 further defines at least one air vent 1319 communicating with the atomizing chamber 133. The horizontal capillary grooves 1317 have a function of absorbing liquid and ventilation.

The air of the atomizing chamber 133 enters the horizontal capillary grooves 1317 or the vertical vent groove 1318 through the air vent 1319, and then converges into the air exchange passage 150, and enters the liquid storage chamber 120 through the air outlet 151 opened by the air compensating valve 142, to supply the pressure in the liquid storage chamber 120.

During the process of opening and closing of the air compensating valve 142, liquid may overflow from the air outlet 151 on the top of the atomizing base 131, and the horizontal capillary grooves can absorb the spilled liquid and lock it in.

In other embodiments, the air exchange passage 150 may communicate with the external air directly. For example, a scavenge port may be disposed on the housing 110, the air exchange passage 150 communicates with the external air directly through the scavenge port, the external air enters the air exchange passage 150 through the scavenge port, and then enters the liquid storage chamber 120 through the air outlet 151 opened by the air compensating valve 142, to supply the pressure in the liquid storage chamber 120.

Of course, in other embodiments, the air exchange passage 150 may communicate with the atomizing chamber 133, and communicate with the external air directly at the same time, to supply the pressure in the liquid storage chamber 120.

Figure 13:
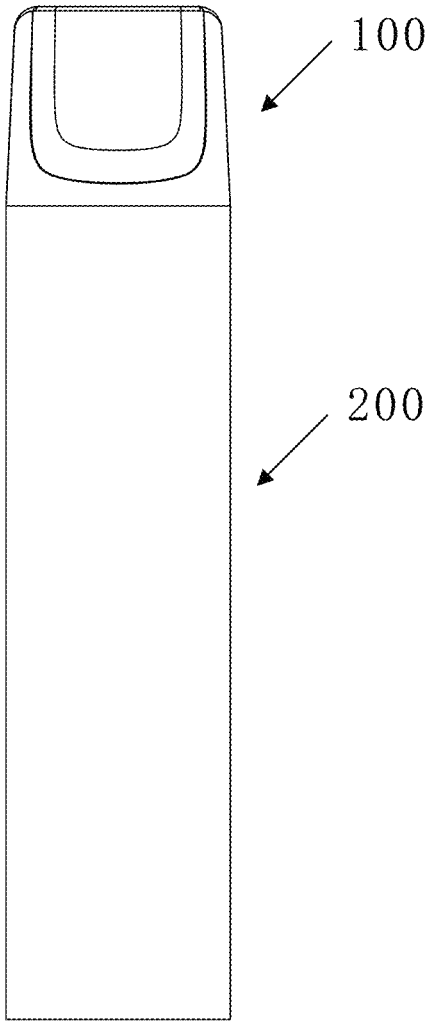
FIG. 13 is a perspective structural schematic view of an embodiment of an electronic atomizing device of the present disclosure.

It should be noted that, the details of a communication between the external air and the liquid storage chamber 120 are also applicable in any one of the embodiments described above. Please refer to FIG. 13, which is a perspective structural schematic view of an embodiment of an electronic atomizing device of the present disclosure.

Another embodiment of the present disclosure provides an electronic atomizing device 200. The electronic atomizing device 200 includes a power supply assembly (the power supply assembly is disposed within the electronic atomizing device 200, and is not shown in the FIGS) and an atomizer 100 of any one of the embodiments described above. The electronic atomizing device 200 further includes the power supply assembly; the power supply assembly 210 is configured to power the atomizer 100, to enable the atomizer 100 to atomize the aerosol generating material into smoke.

In summary, during operation of the electronic atomizing device 200 of the present disclosure, when the pressure of the external air on the second side 1422 is greater than the pressure in the liquid storage chamber 120 on the first side 1421, and the differential-pressure reaches a threshold which can push the air compensating valve 142 to rotate, the air compensating valve 142 is opened, the external air enters the liquid storage chamber 120 through the air compensating valve 142, to supply the air pressure in the liquid storage chamber 120, and avoid a situation that the air pressure in the liquid storage chamber 120 being too low, liquid cannot penetrate to the atomizing assembly 130 for atomization, so as to improve a fluency of atomizing liquid supply, and avoid a situation that the atomizing assembly 130 is overheated due to an unsmooth liquid supply. In a normal situation, the pressure in the liquid storage chamber 120 is greater than or equal to the pressure of the external air, the liquid storage chamber 120 supplies liquid smoothly, and the air compensating valve 142 is in a closed state, to prevent the aerosol generating material inside the liquid storage chamber 120 from leaking from the air compensating valve 142.

The above description are only embodiments of the present disclosure, and do not limit the scope of the present disclosure. Any equivalent structure or equivalent process transformation made by using the contents of the description and drawings of the present disclosure, or directly or indirectly used in other related technical fields, are similarly included in the scope of patent protection of the present disclosure.

What is claimed is:

1. An atomizer, comprising:

a housing, defining a first airflow passage through an inlet end and an outlet end;

a liquid storage chamber, disposed within the housing;

an atomizing assembly, disposed in a path of the first airflow passage, and being in fluid connection with the liquid storage chamber; and a sealing element, comprising a sealing body and an air compensating valve, the sealing body being configured to form a seal between the housing and the atomizing assembly, the air compensating valve comprising a first side and a second side opposite to each other, the first side being located within the liquid storage chamber, the second side communicating with external air; wherein the air compensating valve is opened when a pressure of the external air on the second side is greater than a pressure in the liquid storage chamber on the first side;

wherein the air compensating valve and the sealing body are integrally formed.

2. The atomizer of claim 1, wherein the air compensating valve is a one-way valve.

3. The atomizer of claim 2, wherein the sealing body is a sealing silicone element, the air compensating valve is an elastic element.

4. The atomizer of claim 3, further comprising a blocking element, configured to limit opening amplitude of the elastic element; wherein the elastic element is a rubber elastic element.

5. The atomizer of claim 4, wherein the elastic element is disposed perpendicular to a central axis of the atomizer.

6. The atomizer of claim 5, wherein the atomizing assembly comprises an atomizing base, an outer surface of the atomizing base defines a groove; the groove communicates with the external air, and extends into the liquid storage chamber; the sealing silicone element sheathes on the outer surface of the atomizing base, an air exchange passage is defined by the sealing silicone element and the groove and allows the external air to enter the liquid storage chamber, an end of the air exchange passage near the liquid storage chamber severs as an air outlet.

7. The atomizer of claim 6, wherein the air outlet is located at a side of the atomizing base near the liquid storage chamber, the air outlet is located at a plane perpendicular to the central axis of the atomizer, and the elastic element covers the air outlet.

8. The atomizer of claim 7, wherein a supporting part is disposed on a top of the atomizing base, a center of the supporting part recesses to form a receiving chamber to receive the elastic element, a width of the receiving chamber is greater than a width of the elastic element.

9. The atomizer of claim 6, wherein the blocking element comprises a first step surface disposed on an inner surface of the housing, the first step surface abuts against a first end of the elastic element connected to the sealing body, and the first end of the elastic element is located between the atomizing base and the first step surface.

10. The atomizer of claim 5, wherein the elastic element is disposed parallel to a central axis of the atomizer.

11. The atomizer of claim 10, wherein the atomizing assembly comprises an atomizing base, an outer surface of the atomizing base defines a groove; the groove communicates with the external air, and extends into the liquid storage chamber; the sealing silicone element sheathes on the outer surface of the atomizing base, an air exchange passage is defined by the sealing silicone element and the groove and allows the external air to enter the liquid storage chamber, an end of the air exchange passage near the liquid storage chamber severs as an air outlet.

12. The atomizer of claim 11, wherein the atomizing base defines a vertical groove along a direction parallel to the central axis of the atomizer inside the atomizing base, an end of the vertical groove communicates with the liquid storage chamber, the vertical groove comprises a first side wall and a second side wall opposite to the first side wall, the air outlet is located at the first side wall, and the elastic element covers the air outlet.

13. The atomizer of claim 11, wherein the second side wall serves as the blocking element, the elastic element abuts against the first side wall, a distance between the first side wall and the second side wall is greater than a thickness of the elastic element, and less than a length of the elastic element.

14. The atomizer of claim 11, wherein the outer surface of the atomizing base is provided with a plurality of fins, the plurality of fins are arranged with intervals, adjacent fins define horizontal capillary grooves, the atomizing base further comprises at least one vertical vent groove, the at least one vertical vent groove communicates with the horizontal capillary grooves, the atomizing base further defines at least one air vent communicating with an atomizing chamber of the atomizing assembly.

15. The atomizer of claim 3, wherein the elastic element comprises a first end connected to the sealing silicone element and a second end opposite to the first end, a width of the first end is less than a width of the second end.

16. An electronic atomizing device, comprising a power supply assembly and an atomizer, the power supply assembly being configured to power the atomizer, to enable the atomizer to atomize aerosol generating material into smoke, the atomizer comprising:

a housing, defining a first airflow passage through an inlet end and an outlet end;

a liquid storage chamber, disposed within the housing;

an atomizing assembly, disposed in a path of the first airflow passage, and communicated with the liquid storage chamber; and a sealing element, comprising a sealing body and an air compensating valve, the sealing body being configured to form a seal between the housing and the atomizing assembly, the air compensating valve comprising a first side and a second side opposite to each other, the first side being located within the liquid storage chamber, the second side communicating with external air; wherein the air compensating valve is opened when a pressure of the external air on the second side is greater than a pressure in the liquid storage chamber on the first side;

wherein the air compensating valve and the sealing body are integrally formed.

17. The electronic atomizing device of claim 16, wherein the air compensating valve is closed when the pressure of the external air on the second side is less than or equal to the pressure in the liquid storage chamber on the first side.

18. The electronic atomizing device of claim 16, wherein the sealing body is a sealing silicone element, the air compensating valve is an elastic element.

19. The electronic atomizing device of claim 18, wherein the elastic element comprises a first end connected to the sealing body and a second end opposite to the first end, when the pressure of the external air on the second side is greater than the pressure in the liquid storage chamber on the first side, the second end rotates relative to the first end to open the elastic element.

20. The electronic atomizing device of claim 19, wherein the elastic element is disposed perpendicular to a central axis of the atomizer or the elastic element is disposed parallel to the central axis of the atomizer.

* * * * *